United States Patent [19]

Körber et al.

[11] 4,235,491

[45] Nov. 25, 1980

[54] REPOSITORY FOR STORAGE OF PAPER MONEY OR OTHER VALUABLES

[75] Inventors: Kurt A. Körber, Hamburg; Johannes Mielke, Reinbek, both of Fed. Rep. of Germany

[73] Assignee: Hauni-Werke Körber & Co. KG, Hamburg, Fed. Rep. of Germany

[21] Appl. No.: 2,317

[22] Filed: Jan. 10, 1979

[30] Foreign Application Priority Data

Jan. 16, 1978 [DE] Fed. Rep. of Germany ..... 2801737
May 18, 1978 [DE] Fed. Rep. of Germany ..... 2821629

[51] Int. Cl.[3] ..... A47B 77/08; E05G 3/00

[52] U.S. Cl. ..... 312/223; 312/268; 312/297; 109/4

[58] Field of Search ..... 312/223, 134, 208, 268, 312/296, 297; 109/4, 5, 10, 11, 17

[56] References Cited

U.S. PATENT DOCUMENTS

| | | | |
|---|---|---|---|
| 544,138 | 8/1895 | Ullrich | 312/297 |
| 1,195,309 | 8/1916 | White | 312/217 |
| 2,049,969 | 8/1936 | Meunier et al. | 312/297 |
| 3,141,123 | 7/1964 | Olson | 312/268 |
| 3,159,441 | 12/1964 | Sikma | 312/268 |
| 3,199,936 | 8/1965 | Kuhlmann | 312/208 |
| 3,240,546 | 3/1966 | Gibbons | 312/223 |
| 3,345,117 | 10/1967 | Goldammer et al. | 312/268 |
| 3,578,143 | 5/1971 | Woodward | 312/223 |
| 3,936,112 | 2/1976 | Scholfield | 312/223 |

*Primary Examiner*—Victor N. Sakran
*Attorney, Agent, or Firm*—Peter K. Kontler

[57] ABSTRACT

A safe for storage of paper money has a reinforced housing for several upright containers each having a row of superimposed drawers for reception of stacks of paper money. Bills of different denominations are stored in different containers, and the open sides of drawers in each container can be exposed or concealed by discrete closures which are movable up to expose a larger number of respective drawers or down to conceal one or more additional drawers in the respective containers. Each closure is normally locked in the selected position against movement in a direction to expose additional drawers, and such locking action can be interrupted only by depressing a pushbutton which actuates a clock so that the latter releases the respective locking device with a preselected delay. Once the selected interval of time has elapsed, the corresponding closure can be lifted by a step so as to expose a single additional drawer of the respective container. The locking devices for the compartments may comprise self-locking worm drives or cooperating ratchet wheels and pawls. A second time delay device is used to prevent immediate detachment of the safe from its support.

20 Claims, 5 Drawing Figures

REPOSITORY FOR STORAGE OF PAPER MONEY OR OTHER VALUABLES

BACKGROUND OF THE INVENTION

This invention relates to safes in general, and more particularly to improvements in safes or repositories for temporary or permanent storage of valuables, e.g., paper money. Still more particularly, the invention relates to improvements in repositories or safes of the type wherein compartments, e.g., drawers, for storage of notes or bills of various denominations, jewels, watches, travellers' checks and/or securities can be exposed or concealed so as to be accessible for insertion or authorized removal of valuables but are protected against unauthorized removal.

The terms "repository" and "safe" are intended to denote portable or permanently installed strong boxes for valuables, including boxes for paper money of various denominations which are utilized in banks and related institutions wherein cashiers, tellers or other agents accept valuables from customers or employees and/or hand out valuables in payment for goods or services or in exchange for checks or bills. Institutions most likely to utilize the improved repository or safe are banks, currency exchanges, lending institutions and similar establishments which are visited by members of the general public.

The number of robberies of banks and other money collecting, paying or lending agencies, jewelry stores, department stores and other establishments which receive and pay out large amounts of money is on the increase. Therefore, such establishments are compelled to undertake extensive precautionary measures, not only to prevent robberies and/or to reduce the sums of money or other valuables which can be appropriated by criminals in the course of a robbery, but also (and normally even more) to protect the employees and/or members of the public from bodily harm or mental anguish in the course and/or as a consequence of a holdup. It is not sufficient merely to insure that the valuables which are manipulated by an agent, e.g., a teller in a bank, who handles large sums of money or other negotiables are adequately protected by being kept out of reach of unauthorized persons (for example, by confining the agent in a bulletproof and hermetically sealed cage). The laws of many countries already provide that the cages for tellers in banks and like institutions must be bulletproof and should not be accessible when the institution is open to the public. However, a robber is likely to threaten one or more customers and/or employees with bodily harm and thus compel a teller to hand over large amounts of valuables in exchange for release of the hostages. Therefore, the perpetrators often get away with large hauls in spite of the fact that they are prevented from gaining direct access to the safe or safes.

It was already proposed to thwart attempts to rob a bank or a similar institution by insuring that the robber or would-be robber is aware of inability of the agent in charge to hand over substantial sums of money or other valuables. To this end, the valuables are confined in strongly reinforced boxes or safes which can be opened only with a predetermined delay. Thus, a bank teller is unable to hand over a large sum of money, even if he or she is willing to satisfy the demands of a robber, because a signal to open the safe is followed by a preselected interval which must elapse before the contents of the safe become accessible to anyone including the agent in charge. A would-be robber who is aware of such design of the safe is likely to desist from a holdup because, as a rule, a holdup is carried out within a matter of a few minutes. The likelihood of apprehension, either by a police patrol which happens to pass by, by several bank guards or even by aroused employees and/or customers increases from second to second so that a criminal or would-be criminal who enters a bank with the intent of staging a robbery is likely to leave and seek an easier target if such person notes that the agent in charge is incapable of handing over a substantial amount of valuables, even if one or more hostages are threatened with bodily harm. Threats to hostages are to no avail since the criminal must await the elapse of a preselected interval of time regardless of whether or not the agent in charge and/or other employees or customers are held hostage.

The just discussed proposal exhibits the drawback that, in order to insure adequate security, the safe must be constructed and assembled in such a way that its manipulation interferes with normal work of the agent in charge, i.e., the agent must permit a relatively long interval of time to elapse even at a time when no holdup is in progress and no holdup is likely to occur.

OBJECTS AND SUMMARY OF THE INVENTION

An object of the invention is to provide a safe or repository for valuables which is constructed and assembled in such a way that its manipulation does not unduly interfere with the work of the person in charge but the safe prevents unauthorized persons from rapidly removing or compelling removal of the entire contents of the safe.

Another object of the invention is to provide a safe of the just outlined character which is designed in such a way that access to more valuable contents is more difficult than access to contents whose value is lower, e.g., which prevents immediate withdrawal of large sums of money in bills of higher denomination but enables an agent to gain access to bills of lower denomination with a delay which is but a fraction of the delay required to reach larger bills.

A further object of the invention is to provide the safe with novel and improved means for enabling an authorized person to select, in advance, the delays with which various classes of stored valuables can be reached by the employee in charge.

An additional object of the invention is to provide a safe which is simple and compact, which is of eye-pleasing appearance, which can be readily transported into and from a vault (if and when necessary), and which can be readily manipulated by unskilled persons with a minimum of training.

A further object of the invention is to provide a safe which enables an authorized employee or agent to complete the transactions in a normal way, even during rush hours (e.g., at noon time on Fridays if the safe is used in a bank), but invariably thwarts any and all attempts of a robber to obtain substantial sums of money within a relatively short interval of time.

Another object of the invention is to provide novel and improved means for attaching the safe to a support in such a way that detachment of the safe is impossible or can be completed only with a delay which is evidently unacceptable to a criminal during business hours or even in the course of an attempted burglary while the institution which utilizes the safe is not open to the public.

A further object of the invention is to provide a safe which can be used for temporary or longer-lasting storage of a practically unlimited variety of valuables even though it is especially suited for use in banks and similar institutions which handle large amounts of bills, checks and other negotiable instruments capable of being stacked in discrete compartments of a repository.

The invention is embodied in a safe for storage of paper money or other valuables which comprises one or more containers each having a plurality of compartments for storage of valuables which can be inserted into or removed through an open side of the respective compartment, closing means for the open sides of compartments (preferably a discrete closure for each container), such closing means being movable between a plurality of positions in each of which a different number of open sides of compartments in the respective container is accessible, releasable locking means for the closing means (such locking means is preferably designed to permit practically unobstructed movement of each closing means in a direction to reduce the number of exposed or accessible compartments in the corresponding container but invariably prevents movement of the closing means in a direction to expose a larger number of compartments in the respective container), means for generating signals at desired intervals (the signal generating means may comprise switches having pushbuttons or analogous actuating elements which are within reach of the person in charge so that such person can depress a pushbutton when the need arises or is about to arise), and means for releasing the locking means with a predetermined delay following the generation of a signal to permit movement of the corresponding closing means to a different position, particularly to a position in which an additional compartment of the corresponding container becomes accessible.

The compartments of each container are preferably adjacent to each other. They may form a vertical or nearly vertical row of superimposed compartments whose open sides face toward the agent in charge. The closing means then preferably comprises a discrete closure (e.g., a closure assembled of articulately connected slats) for each container, and each closure is preferably movable with a minimum of effort in a first direction to reduce the number of exposed or accessible compartments but can move in the opposite (second) direction to expose a larger number of compartments in the respective container only after elapse of the delay which has been selected in advance for the corresponding closure. The safe preferably further comprises means for limiting the extent of movement of each closure in the second direction so that each movement in the second direction results in accessibility of a single additional compartment in the corresponding container. Thus, and assume that a teller has decided to pull down a closure to such an extent that a single valuables-containing compartment of the respective container remains accessible, the locking means for the just mentioned closure then prevents the teller from exposing two or more additional valuables-containing compartments of the respective container except by repeatedly depressing the associated pushbutton and permitting the requisite intervals of time to elapse in order to move the closure stepwise in a direction to expose two, three or more valuables-containing compartments.

If each container stores bills of different denominations, the delays for movement of closures for containers storing bills of larger denominations will be selected in such a way that they are longer than the delays which are needed to afford access to the compartments of a container which stores bills of smaller denominations. This enables the teller to perform his or her duties in the customary way even though the teller is capable of gaining access to a relatively small fraction of the total amount of valuables in the safe. Therefore, a robber who threatens the teller and/or other persons in the bank must be satisfied with a relatively small haul or risk apprehension by awaiting the completion of stepwise movements of one or more closures in directions to afford access to additional filled compartments.

The novel features which are considered as characteristic of the invention are set forth in particular in the appended claims. The improved safe itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
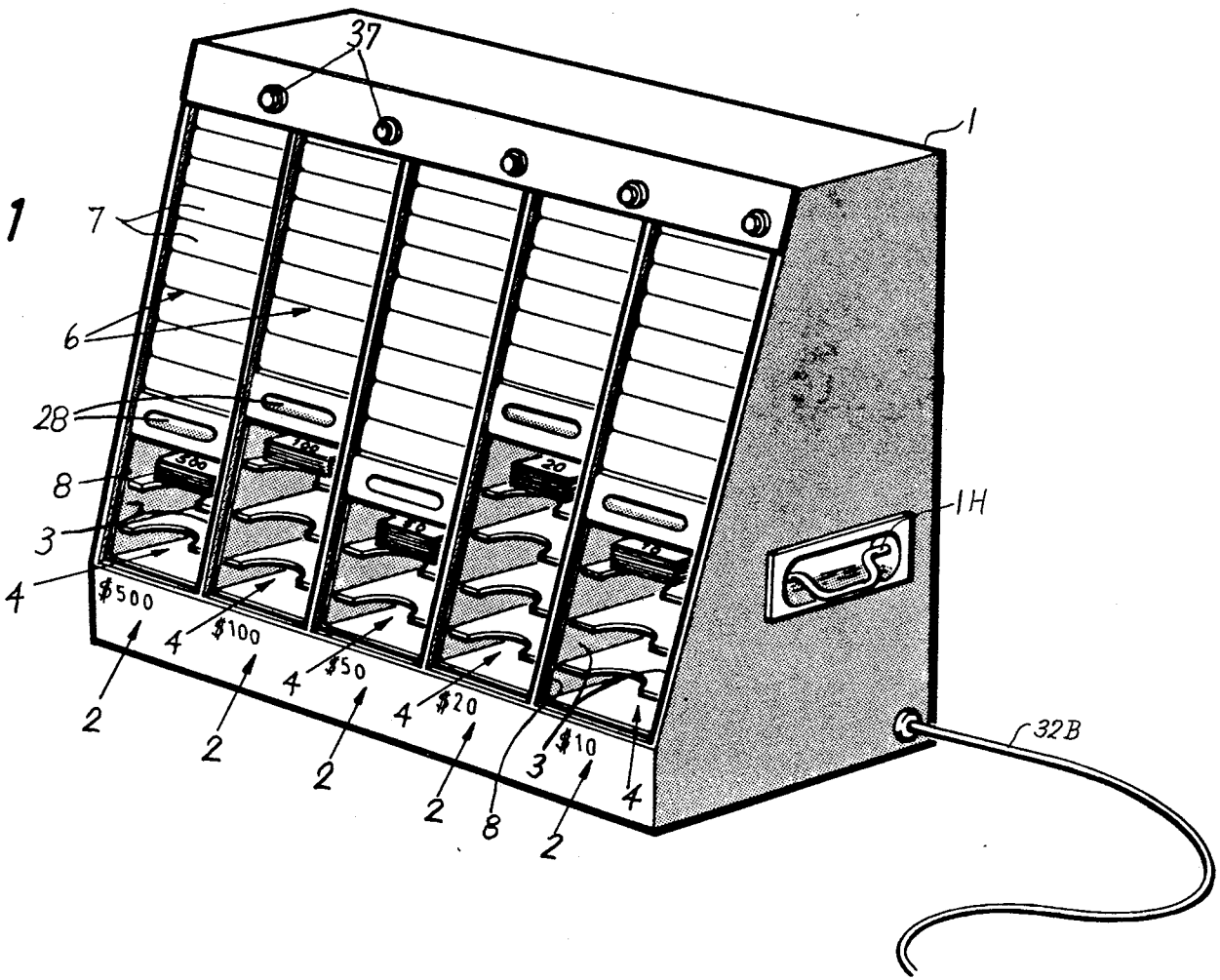
FIG. 1 is a perspective view of a safe which embodies one form of the invention and comprises five neighboring containers mounted in a reinforced housing.

FIG. 1 shows a safe which comprises a reinforced housing 1 made of sheet steel or other suitable material and comprises five upright containers 2 each having a row of superimposed compartments or drawers 4 for storage of valuables. By way of example, the upper drawers 4 of the rightmost container 2 store stacks of ten dollar bills, certain drawers of the adjacent container store twenty dollar bills, certain drawers of the middle container store fifty dollar bills, certain drawers of the next-following container store one hundred dollar bills, and certain drawers of the leftmost container store five hundred dollar bills.

Neighboring containers 2 are separated from each other by partitions 3, and similar partitions or side walls 3 are or can be provided at the outer sides of the two outermost containers. The dimensions (height) of the drawers 4 are selected in such a way that each thereof can store a limited amount of currency of the corresponding denomination. In other words, and assuming that the number of exposed drawers 4 corresponds to that shown in FIG. 1, a teller or another person can immediately gain access to a single stack of bills in each of the five containers 2.

Figure 2:
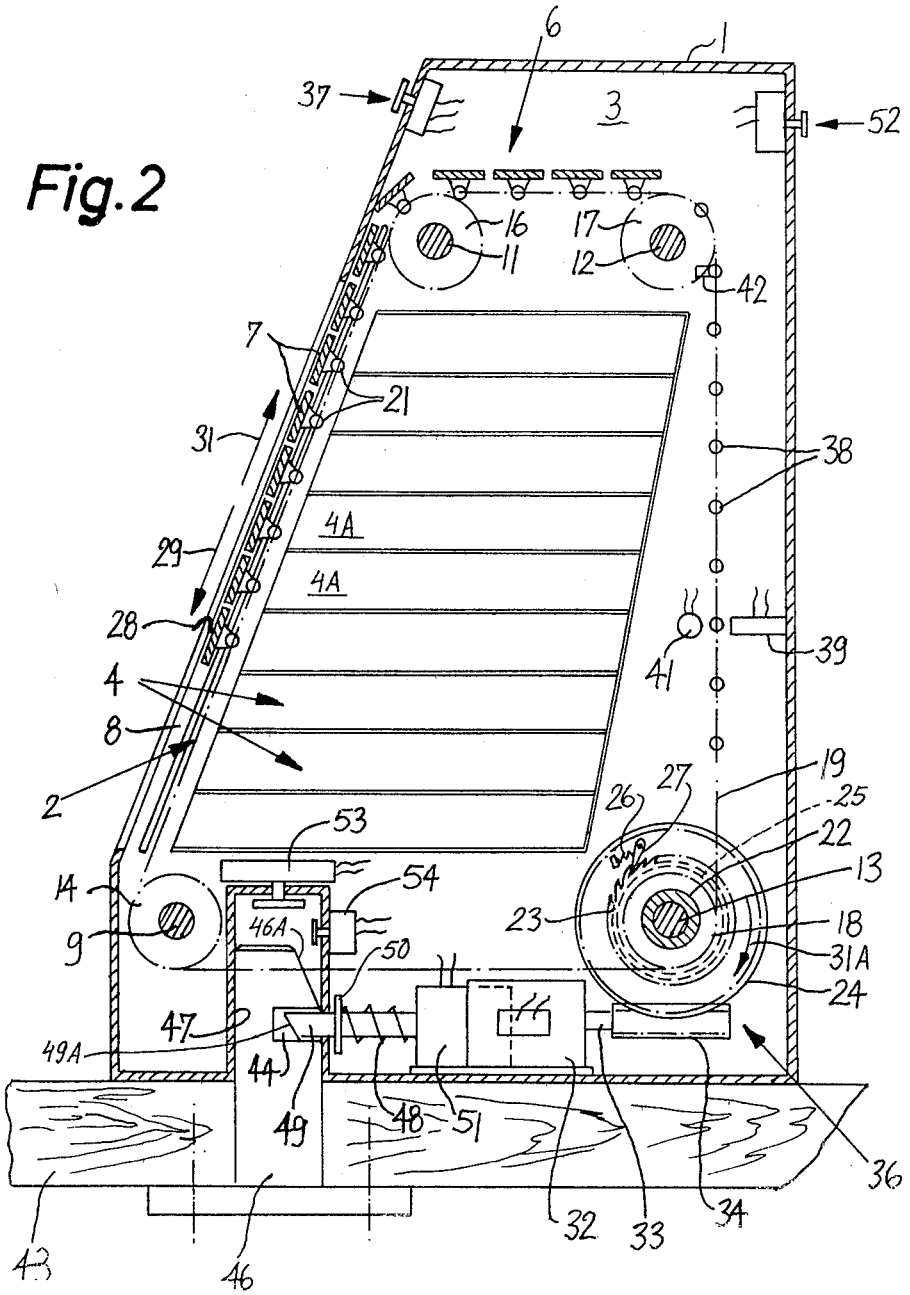
FIG. 2 is an enlarged transverse vertical sectional view of a container in the safe of FIG. 1.

The means for closing the drawers 4 of the five containers 2 comprises five discrete closures 6 each of which is a mobile gate assembled of several articulately connected slats 7. Each closure 6 is movable up or down independently of other closures. The marginal portions of slats 7 which form part of the closures 6 are slidable in guide slots 8 provided therefor in the corresponding partitions and side walls 3. These guide slots are located forwardly of the open front sides 4A (see FIG. 2) of the drawers 4 in corresponding containers 2. Each closure 6 further comprises two endless flexible elements in the form of chains 19 (one shown in FIG. 2) which are trained over sprocket wheels 14, 16, 17 and 18. These sprocket wheels are respectively mounted on horizontal shafts 9, 11, 12 and 13 which are installed in the housing 1 adjacent to the group of five containers 2. The two chains 19 of each closure 6 are immediately or closely adjacent to the partitions or side walls 3 of the corresponding container 2. The chains 19 of each pair are connected to each other by horizontal rungs 21 which carry the respective slats 7. FIG. 2 shows that the length of the curtain of slats 7 need not match the length of the corresponding chains 19, i.e., all that counts is to insure that the length of a curtain (as considered in the longitudinal direction of the respective row of drawers 4) matches or at least slightly exceeds the height of the respective container 2.

The sprocket wheels 14, 16, 17 are freely rotatable on or with the respective shafts 9, 11, 12. The sprocket wheels 18 for each pair of chains 19 are secured to and can rotate with a hollow shaft or sleeve 22 which surrounds the corresponding portion of the shaft 13 (i.e., each sleeve 22 extends between the partitions or side walls 3 of the corresponding container 2). Each hollow shaft or sleeve 22 is rigidly connected with a ratchet wheel 23 which is enaged by a pawl 27 pivotally secured to a worm wheel 24 and biased against the periphery of the respective sprocket wheel 23 by a spring 26. Each worm wheel 24 surrounds the respective sleeve 22 and is coupled thereto by a one-way clutch 25 (indicated by a broken-line circle) in such a way that, by grasping a handle 28 on the corresponding closure 6, a teller can move the closure in a first direction (arrow 29 in FIG. 2) to reduce the number of exposed open sides 4A in the corresponding container 2. On the other hand, the closure 6 can be moved in the opposite (second) direction (indicated in FIG. 2 by arrow 31) only by rotating the worm wheel 24 in the appropriate direction (indicated by arrow 31A shown in FIG. 2). The movement of a closure 6 in the direction of arrow 29 necessitates the exertion of a small effort, i.e., such work can be readily performed by a female teller in a bank or a similar institution.

The means for moving the closures 6 in directions indicated by arrow 31 shown in FIG. 2 comprises discrete electric motors 32, one for each container 2, whose output elements 33 carry worms 34 in mesh with the respective worm wheels 24. Each worm wheel 24 constitutes with the respective worm 34, ratchet wheel 23 and pawl 27 a releasable locking device 36 which normally holds the corresponding closure 6 against movement in the direction of arrow 31 and permits such movement only when the corresponding motor 32 is started.

A motor 32 can be started (i.e., the corresponding locking device 36 can be released) with a preselected delay following actuation of a signal generating device here shown as a switch including a pushbutton or knob 37 mounted on the housing 1 within reach of the agent who is sitting or standing in front of the safe, i.e., to the left of the housing 1, as viewed in FIG. 2. FIG. 1 shows that a discrete pushbutton 37 is mounted in the housing 1 at a level above each container 2.

Figure 3:
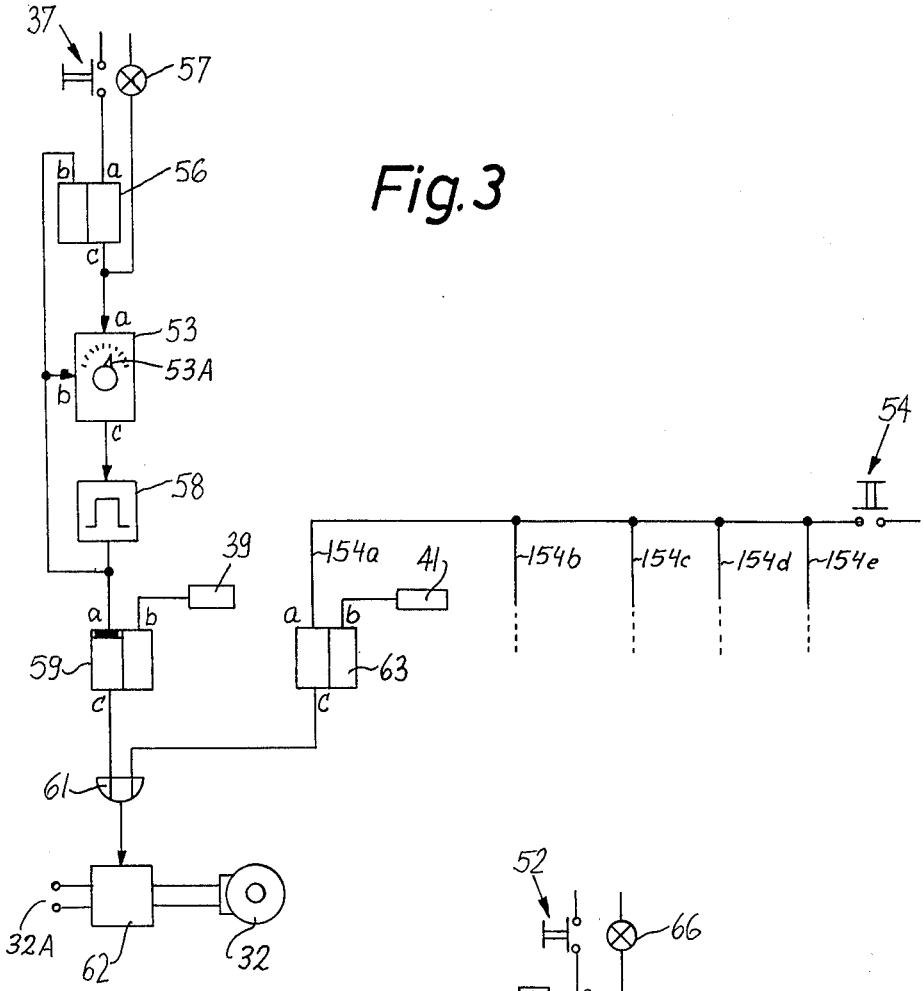
FIG. 3 is a circuit diagram of means for generating signals and for releasing the locking means for the closure of the container shown in FIG. 2.

FIG. 3 shows a circuit which includes a signal generating device including the pushbutton 37 for one of the containers 2 and the corresponding electric motor 32. The releasing means for the corresponding locking device 36 comprises an electric clock 53 having adjusting means in the form of a turnable finger 53A movable with respect to a graduated scale to select the delay which must elapse following depression of a pushbutton 37 in order to complete the circuit of the respective motor 32.

The safe further comprises means for limiting the extent of movement of each closure 6 in the direction of arrow 31, i.e., each closure can only move in such direction by a step so as to expose a single additional open end 4A in the corresponding container 2. Such limiting means comprises a proximity detector 39 which is installed in the circuit of FIG. 3 and receives impulses from actuating elements or trips 38 on one of the corresponding chains 19.

A second proximity detector 41 is actuated by a trip 42 on one of the corresponding chains 19 to transmit a signal when the respective closure 6 is lifted to such an extent that the open end 4A of the last or uppermost drawer 4 in the corresponding container 2 is also exposed. The trips 38 for the proximity detector 39 are designed in such a way that they cannot actuate the proximity detector 41.

The housing 1 of the safe is detachably mounted on a support 43, e.g., a beam or a like solid part in the cage of a teller. To this end, the support 43 fixedly carries a projection or post 46 which is securely anchored therein and has a notch 44 for the front end of a locking bolt 49 constituting the reciprocable armature of an electromagnet 51. When the electromagnet 51 is deenergized, a helical spring 48 bears against a collar 50 and urges the tip of the armature 49 into the notch 44 so that the housing 1 is securely attached to the support 43 as long as the electromagnet 51 remains deenergized. The electromagnet 51 is mounted in the housing 1 adjacent to the respective motor 32.

Figure 4:
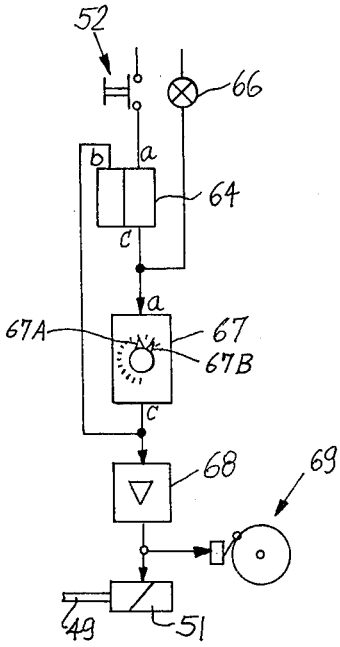
FIG. 4 is a circuit diagram of means for releasing a device which secures the housing of the safe of FIG. 1 to a suitable support.

The post 46 extends into a socket 47 in the underside of the housing 1. When the housing 1 is placed onto the support 43 so that the post 46 enters the socket 47, the inclined cam face 46A of the post 46 engages the complementary inclined cam face 49A at the front end of the armature 49 and depresses the latter until the bottom wall of the housing 1 comes to rest on the support 43. The spring 48 is then free to expand and to propel the armature 49 into the notch 44 of the fully inserted post 46. The electromagnet 51 can be energized (to retract the armature 49 from the notch 44) by a circuit which is shown in FIG. 4. This circuit includes a switch 52 which generates a signal in response to depression of its movable portion or pushbutton. The switch 52 is mounted at the rear side of the housing 1.

The socket 47 in the underside of the housing 1 is not completely filled when the housing is attached to the support 43. The upper portion of this socket contains the aforementioned electric clocks 53 which constitute or form part of means for releasing the associated locking devices 36. Furthermore, that portion of the socket 47 which is not occupied by the post 46 contains an electric switch 54 which is common to all five circuits of the type shown in FIG. 3. Thus, the switch 54 and the clocks 53 (together with their adjusting means 53A)

are normally concealed so that they cannot be reached when the armature 49 secures the housing 1 to the support 43. The socket 47 can extend transversely of the entire housing 1, and the post 46 may constitute an elongated body which completely fills the entire lower part of the socket all the way between the two side walls of the housing 1.

The circuit of FIG. 3 is one of five discrete circuits, one for each container 2. This circuit comprises the respective pushbutton 37 forming part of a switch one contact of which is connected with the setting input a of a signal storing flip-flop circuit 56. The output c of the flip-flop circuit 56 is connected with the input a of the respective clock 53. The output c of the clock 53 is connected with a light source 57 (e.g., a glow diode) which is observable from the front side of the housing 1 (e.g., through the respective pushbutton 37) and with the input of a suitable pulse shaper 58 which transmits signals of predetermined configuration to the dominant input a of a second signal storing flip-flop circuit 59. The output of the pulse shaper 58 is further connected with the erasing inputs b of the circuit 56 and clock 53. The erasing input b of the circuit 59 is connected with the output of the respective proximity detector 39 and its output c is connected with one input of an OR gate 61 whose output is connected with the control circuit 62 for the respective motor 32.

The aforediscussed switch 54 is common to all five circuits of the type shown in FIG. 3. When the switch is closed by hand (i.e., when the housing 1 is detached from the support 43 so that the interior of the socket 47 is accessible), it transmits a signal to the setting inputs a of five signal storing flip-flop circuits 63 whose erasing inputs b are connected with the outputs of the respective proximity detectors 41 and whose outputs c are connected with the control circuits 62 for the motors 32 via corresponding OR gates 61.

The circuit of FIG. 4 comprises the aforementioned switch 52 which, when actuated, transmits a (second) signal to the input a of a signal storing flip-flop circuit 64 whose output c is connected with the input a of the electric shock 67 and with a light source 66 observable at the rear side of the housing 1, e.g., through the pushbutton of the switch 52. The output c of the clock 67 is connected with the erasing input b of the circuit 64 as well as with an amplifier 68 for the electromagnet 51. Furthermore, the output of the amplifier 68 is connected with a signal generating device 69, e.g., a bell or buzzer.

The clock 67 is preferably of the type which is adjustable in order to select the delay with which a signal transmitted by the output c of the circuit 64 is caused to initiate the operation of the clock and preferably also in order to vary the interval during which a signal which is generated by the clock is transmitted to the amplifier 68. FIG. 4 shows two fingers 67A and 67B which are movable with reference to a suitably graduated scale on the casing of the clock 67 to respectively select the aforediscussed delays. The clock 67 is automatically reset to zero when the amplifier 68 receives a signal. At such time, the signal which is transmitted by the light source 66 disappears because the output signal of the clock 67 is transmitted to the erasing input b of the flip-flop circuit 64.

The improved safe is operated as follows:

After business hours, the housing 1 is stored in the vault of the institution, e.g., in the vault of a bank. The vault is opened before the bank opens for business and the housing 1 is transported or manually transferred into a cage of a teller. Prior to attaching the housing 1 to the support 43, the teller or another person in charge of mounting the housing in the cage depresses the pushbutton of the switch 54 in the socket 47 so as to transmit signals to the inputs a of all five flip-flop circuits 63 (FIG. 1 merely shows a single circuit 63 but illustrates five conductors **154*a*, 154*b*, 154*c*, 154*d* and 154*e* which connect the switch 54 with the five circuits 63). The outputs c of the five circuits 63 transmit signals to the corresponding control circuits 62 via OR gates 61 so that the motors 32 are started. The motors 32 drive the respective worms 34 to rotate the associated worm wheels 24 in the direction indicated by arrow 31A. The worm wheels 24 drive the associated sleeves 22 via clutches 25 so that the closures 6 move in the directions indicated by arrow 31. The proximity detectors 39 cannot interrupt such movements of the closures 6 because the control circuits 62 receive signals via flip-flop circuits 63 which are not affected by transmission of signals to the erasing inputs b of the corresponding flip-flop circuits 59. The closures 6 are arrested when all of the drawers 4 in the corresponding containers 2 are accessible, i.e., when the trips 42 actuate the respective proximity detectors 41 which transmit signals to the erasing inputs b of the corresponding flip-flop circuits 63. It will be seen that depression of the pushbutton of the switch 54 in the socket 47 results in movement of all closures 6 to the fully open positions. This is desirable and advantageous because the teller can insert stacks of paper money into selected drawers 4 of all five containers 2. As a rule, the teller will insert stacks of paper money of corresponding denominations into the majority of the respective drawers 4 but will preferably leave at least one (namely, the lowermost) drawer 4 of each container 2 empty. This enables the teller to use the empty drawers 4** for insertion of such currency which is deposited by the earliest customers after opening of the bank to the general public.

In the next step, the teller grasps the handles 28 of the closures 6, one after the other, and pulls the closures downward (arrow 29 in FIG. 2) so as to afford access to all empty drawers 4 as well as to the lowermost filled drawer of the respective container 2. As explained above, the closures 6 offer negligible resistance to movement in the direction indicated by the arrow 29 because the corresponding clutches 25 permit rotation of sleeves 22 counter to the direction which is indicated by the arrow 31A of FIG. 2. During such movement of closures 6, the pawls 27 simply ride over the teeth of the corresponding ratchet wheels 23, i.e., the worm wheels 24 remain idle because the motors 32 are disconnected from the energy source 32A. This energy source is connected with the control circuits 62 and amplifier 68 by a cable 32B shown in FIG. 1. Thus, once the closures 6 are moved to selected positions to expose the lowermost filled drawers 4 in the respective containers 2, the teller is unable to lift the closures in order to gain access to additional filled drawers, except by depressing the corresponding pushbuttons 37 and awaiting the elapse of intervals which are selected by setting of the corresponding clocks 53.

The fingers 53A of the clocks 53 are accessible in the interior of the socket 47, i.e., these clocks can be adjusted only as long as the housing 1 remains detached from the support 43. The teller selects appropriate intervals for transmission of signals from the outputs c of the clocks 53 to the respective pulse shapers 58. It is normally desirable to select the delays in such a way that it takes longer to move the closure 6 for drawers 4 which contain paper money of a higher denomination. Thus, the intervals can be short for stepwise lifting of the closure 6 for the drawers 4 which contain ten dollar bills, longer for stepwise lifting of the closure for drawers 4 which contain twenty dollar bills, and so forth. The relationship between various delays which are selected by the fingers 53A of the clocks 53 may be proportional to the ratio of values of bills in the corresponding rows of drawers 4. For example, if the delay with which the rightmost closure 6 of FIG. 1 is lifted by a step is one minute, the delay with which the leftmost closure 6 of FIG. 1 can be lifted by a step is a little less then one hour.

The thus loaded housing 1 (wherein each of the closures 6 affords access to the open side 4A of a single currency-container drawer 4) and is thereupon placed onto the support 43 by grasping the handle 1H (one shown in FIG. 1) so that the post 46 enters the socket 47 and depresses the armature 49 until the latter moves into register with and enters the notch 44 in response to the bias of the spring 48 (which stores energy while the cam face 46A bears against and depresses the cam face 49A). Once the housing 1 is secured to the support 43, the switch 54 and the clocks 53 are not accessible to the teller and/or to any other person except by energizing the electromagnet 51 in order to withdraw the armature 49 from the notch 44.

If the teller notes that the supply of bills in an accessible drawer 4 is about to be exhausted or is likely to be exhausted within a certain interval of time which corresponds to the delay selected by the corresponding clock 53, the teller depresses the respective pushbutton 37 to transmit a signal to the input a of the corresponding flip-flop circuit 56. The output c of the circuit 56 transmits a signal to the input a of the respective clock 53 which delays the signal for the preselected interval of time. The signal which is transmitted by the output c of the circuit 56 is further used to complete the circuit of the corresponding light source 57 so that the teller is informed that the selected closure 6 is about to move in the direction of arrow 31 after elapse of the preselected interval. When the output c of the clock 53 transmits a signal to the pulse shaper 58, the latter transmits erasing signals to the inputs b of the circuit 56 and clock 53 (i.e., the clock 53 is reset to zero and the output c of the circuit 56 ceases to transmit a signal so that the circuit of the light source 57 is interrupted) and a signal to the dominant input a of the flip-flop circuit 59 whose output c transmits a "start" signal to the control circuit 62 via OR gate 61. The motor 32 rotates the respective sleeve 22 in the direction of arrow 31A until an oncoming trip 38 reaches the proximity detector 39 which transmits a signal to the erasing input b of flip-flop circuit 59 to thereby arrest the respective motor 32 after the closure 6 has completed a stepwise advance (arror 31) in order to expose the open side 4A of the lowermost currency-containing drawer 4 in the respective container 2.

If the teller anticipates that the supply of currency in a single freshly accessible drawer 4 is not sufficient, the respective pushbutton 37 is depressed for a second time so that the motor 32 is stared again but with the delay which depends on setting of the corresponding clock 53. This holds true regardless of whether the teller repeatedly presses a pushbutton 37 because additional bills of a selected denomination are needed for transactions or the teller is ordered to do so by a robber or another unauthorized person. In other words, a robber must be patient because the teller can hand over only such bills which are available at the time of robbery but is not in a position to hand over additional bills except after the elapse of preselected intervals which cannot be shortened while the housing 1 remains secured to the support 43.

In order to detach the housing 1 from the support 43, one must depress the pushbutton of the switch 52 so as to transmit a (second) signal to the input a of the flip-flop of circuit 64. The output c of the circuit 64 then transmits a signal which starts the clock 67 and also completes the circuit of the light source 66, i.e., the person in charge is aware of the fact that the clock 67 is running and that the electromagnet 51 is about to be energized with the preselected delay. When the selected interval elapses, the output c of the clock 67 transmits a signal to the input b of the circuit 64, the clock 67 is reset to zero, and the amplifier 68 transmits a signal to the electromagnet 51 which retracts the armature 49. At the same time, the amplifier 68 starts the alarm device 69 which informs the person in charge that the housing 1 can be lifted off the support 43 because the armature 49 is retracted from the notch 44. The delay which is selected by the finger 67A is preferably long, e.g., 30 minutes. The spring 48 stores energy and is ready to return the armature 49 to the extended position as soon as the electromagnet 51 is deenergized. The signal at the output c of the clock 67 is erased after a preselected interval (determined by setting of the finger 67B) so that the electromagnet 51 is deenergized and the alarm device 69 is arrested with a delay which suffices to lift the housing 1 off the support 43. The person in charge then depresses the pushbutton of the switch 54 in the socket 47 so that the motors 32 are started in the aforementioned manner and move all five closures 6 to their fully open positions. This enables the teller to remove all bills from the drawers 4 before the empty safe is returned into the vault.

It is clear that the selection of drawers 4 for bills of certain denominations is up to the teller. For example, two or even more than two rows of drawers 4 can be used for reception of bills of one and the same denomination. Furthermore, the safe can be designed in such a way that the capacity of drawers 4 in one or more containers 2 is different from the capacity of drawers in the other container or containers. For example, each drawer 4 of the rightmost row of drawers in FIG. 1 can be larger than the drawers in the other containers so that each drawer can store a substantial number of ten dollar bills. The spacing between the trips 38 for the corresponding container is then such that the respective closure 6 is lifted through a greater distance in order to expose an entire (larger) drawer 4 in response to actuation of the corresponding pushbutton 37.

Figure 5:
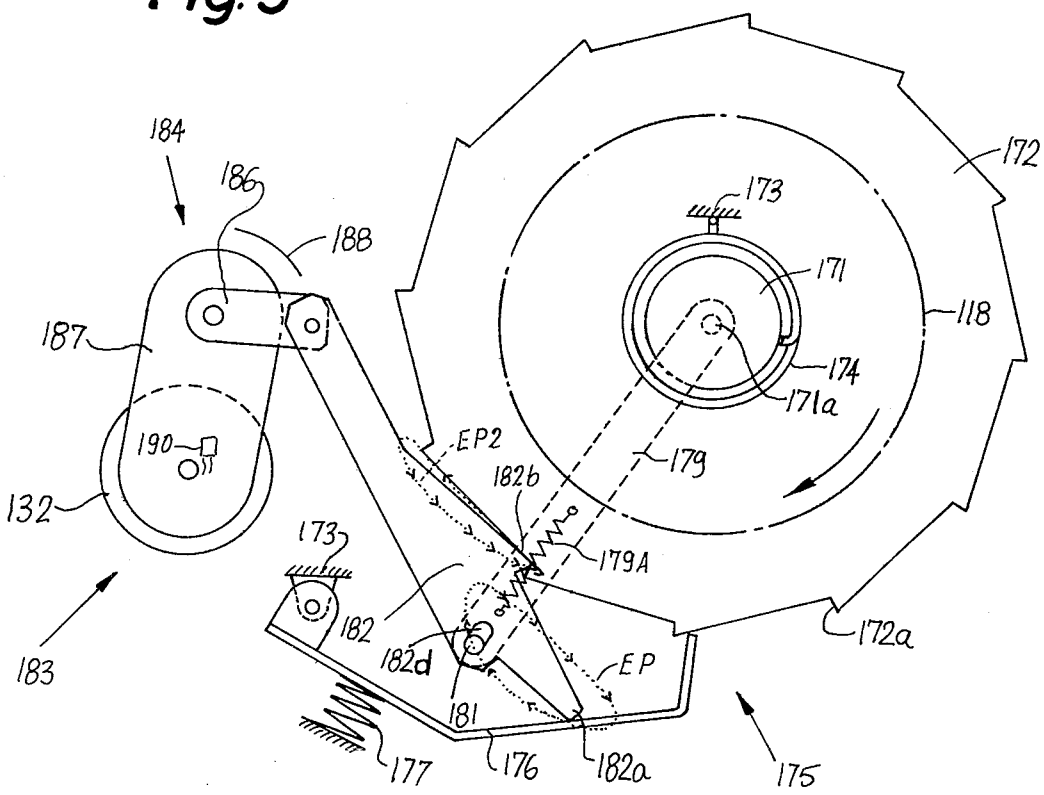
FIG. 5 is a fragmentary transverse vertical sectional view of a modified safe having different locking and releasing means.

FIG. 5 shows a portion of a modified safe. All such parts which are identical with or clearly analogous to corresponding parts of the safe of FIGS. 1 to 4 are denoted by similar reference characters plus 100. The sprocket wheels 118 for each container (not shown) are mounted on a discrete shaft 171 which is further connected with a ratchet wheel 172. The means for rotating the shaft 171 and hence the sprocket wheels 118 in the direction of arrow 131A so as to move the corresponding closure (not shown in FIG. 5) in a direction to expose a filled drawer comprises a torsion spring 174 which is convoluted around the shaft 171 and one leg of which is connected to the casing 173 of the respective container. The other leg of the spring 174 is anchored in the shaft 171 in such a way that the spring stores energy whenever the shaft 171 is rotated in a direction to lower the respective closure, i.e., when the respective closure is pulled downwardly by the respective handle. Therefore, the spring 174 is ready to rotate the shaft 171 in the direction of arrow 131A as soon as the ratchet wheel 172 is free to rotate in such direction.

The ratchet wheel 172 forms part of a modified locking device 175 which further includes a pawl 176 having a pallet which is biased against the teeth 172*a* of the ratchet wheel 171 by a spring 177. The pawl 176 is pivotally mounted in the casing 173 of the respective container. The teeth 172*a* of the ratchet wheel 172 and the pallet of the pawl 176 further perform the function of limiting means 38, 39 of FIGS. 2 and 3, i.e., they cooperate to insure that the corresponding closure can move upwardly only in stepwise fashion, always through a distance corresponding to the height of a drawer in the respective container. This will be readily appreciated since the spring 177 permanently biases the pawl 176 in a counterclockwise direction (as viewed in FIG. 5) so that, if the pallet of the pawl 176 is disengaged from the adjacent tooth 172*a* for a short interval of time so that such tooth can advance beyond the pallet, the pawl 176 invariably engages the oncoming tooth 172*a* if the interval of disengagement of 176 from 172 is shorter than the interval which the spring 174 requires to rotate the ratchet wheel 172 through an angle corresponding to the width of a tooth 172*a* (as considered in the circumferential direction of the shaft 171).

The means for releasing the locking device 175, i.e., for temporarily disengaging the pallet of the pawl 176 from the ratchet wheel 172, comprises a second pawl 182 which is articulately connected to one end portion of a link 179 by means of a pivot pin 181. The pin 181 is received in an elongated slot 182*d* of the pawl 182. The other end portion of the link 179 is mounted on a stud 171 which is mounted on and is coaxial with the shaft 171. A helical spring 179A urges the pawl 182 against the ratchet wheel 172. The second pawl 182 has a pallet 182*a* which can engage an intermediate portion of the pawl 176 in order to disengage the pawl 176 from the ratchet wheel 172. The means for imparting to the pallet 182*a* movements so that the tip of the pallet 182*a* moves along the endless path EP includes a prime mover 183 which is articulately connected with the pawl 182 by a crank arm 186. The prime mover 183 comprises an electric motor 132 which is started in the same way as described in connection with the motor 32 of FIGS. 2 and 3 and a crank gear 184 including the aforementioned crank arm 186. The crank gear 184 further comprises a transmission 187 whose input element receives torque from the motor 132. The arrow 188 indicates the direction in which the crank arm 186 turns when the motor 132 is on. The step-down ratio of the transmission 187 is high so that the speed of angular movement of the crank arm 186 is a small fraction of the RPM of the output element of the motor 132. Furthermore, the transmission 187 may but need not be of the self-locking type to prevent stray movements of the link 186 and second pawl 182. This is desirable because, when the pallet 182*a* disengages the pawl 176 from the ratchet wheel 172, the spring 177 tends to turn the pawl 182 counterclockwise, as viewed in FIG. 5 in order to return the pallet of the pawl 176 into engagement with the ratchet wheel 172.

As mentioned above, the motor 132 is started in the same way as the motor 32 of FIG. 3, i.e., with a preselected delay which cannot be shortened once the housing of the modified safe is secured to its support. A proximity detector 190 is provided to arrest the motor 132 when the tip of the pallet 182*a* completes a movement along the endless path EP. The actuating element or trip for the proximity detector 190 may be provided on or may be constituted by the crank arm 186.

A tooth 182*b* on the pawl 182 can engage the adjacent tooth 172*a* of the ratchet wheel 172. The endless path for movement of the tooth 182*b* while the crank arm 186 turns in the direction of arrow 188 is shown at EP2.

When the motor 132 is idle, the crank arm 186 is held in the six o'clock position, i.e., it is adjacent to the proximity detector 190. If the motor 132 is thereupon started with a delay which is selected by the respective clock corresponding to the clock 53 of FIG. 3, the crank arm 186 turns clockwise and, during the initital stage of its angular movement, pulls the second pawl 182 and pivots the latter in a counterclockwise direction. The tooth 182*b* thereby turns the ratchet wheel 172 counterclockwise to the extent which is necessary to reduce the pressure between the pallet of the pawl 176 and the adjacent tooth 172*a*. The pallet 182 thereupon pivots the pawl 176 clockwise to disengage the latter from the ratchet wheel 172 whereby the spring 174 is free to turn the ratchet wheel 172 in the direction of arrow 131A. The transmission 187 causes the crank arm 186 to turn slowly in the direction of arrow 188 toward and beyond the position shown in FIG. 5. This enables the spring 177 to return the pallet of the pawl 176 into engagement with the ratchet wheel 172, i.e., the pawl 176 intercepts the oncoming tooth 172*a* and arrests the ratchet wheel 172 at the exact moment when the respective closure has been lifted through a distance corresponding to the height of a drawer in the associated container.

The tooth 182*b* of the pawl 182 is disengaged from the ratchet wheel 172 when the crank arm 186 returns to the starting (six o'clock) position. This insures that the spring 174 urges a tooth 172*a* against the pallet of the pawl 176. The proximity detector 190 arrests the motor 132 and the locking device 175 is effective until the teller decides to again depress the corresponding pushbutton in order to start the clock which in turn starts the motor 132 but with the preselected delay.

An advantage of the safe which embodies the structure of FIG. 5 is that the motors 132 need not move the respective closures in a direction to expose additional drawers of the corresponding containers. Such function is performed by the springs 174. The relatively simple, lightweight and inexpensive motors 132 merely serve to move the pawls 182, i.e., to disengage the pawls 176 from the respective ratchet wheels 172. The embodiment of FIGS. 1 and 2 necessitates the use of relatively strong and rather complex motors 32 which must be arrested in accurately selected predetermined positions in response to signals from the corresponding clocks 53. So-called braking motors are rather heavy and expensive.

Another advantage of the structure of FIG. 5 is that it is very simple, sturdy, inexpensive, practically noiseless. Moreover, and even if a criminal gains access to the prime mover 183, he is still incapable of moving the respective closure to fully open position because the pawl 176 cooperates with the ratchet wheel 172 to lock the corresponding closure against movement toward open position. The prime mover 183 actually performs the function of a brake for the pawl 182 whenever the motor 132 is idle. The links 179 and 186 impart to the pawl 182 the aforedescribed movement which results in temporary disengagement of the pawl 176 from the ratchet wheel 172 during each revolution of the crank arm 186 while insuring that the pawl 176 can reengage the ratchet wheel 172 before the respective closure is moved through a distance exceeding the height of a drawer in the corresponding container.

It is further possible to replace the structure of FIG. 5 with an arrangement employing a main pawl and an auxiliary pawl. The auxiliary pawl intercepts the ratchet wheel upon disengagement of the main pawl, the auxiliary pawl is thereupon disengaged from the ratchet wheel, and the latter is again engaged by the main pawl. The just described construction is satisfactory but rather noisy because its mode of operation is somewhat similar to that of the so-called click-clack drives.

An advantage which is common to all embodiments of the improved safe is that the twller is in a position to immediately conceal one or more filled trays 4 so as to reduce the likelihood of substantial losses in the event of a robbery. For example, a teller who has accepted large amounts of currency of a particular denomination so that several filled drawers 4 of the corresponding container 2 are exposed will immediately pull the respective closure 6 in the direction of arrow 29 in order to conceal all but the lowermost filled drawer in such container. This is due to the fact that each closure 6 is always movable in the direction of arrow 29.

The motors 32 and springs 174 are not absolutely necessary, i.e., the safe can be provided with releasing means which does not embody a motor or spring for automatically lifting a selected closure 6 after elapse of the predetermined interval. In other words, the safe can be simplified by omitting the motors 32 and springs 174, and by simply providing means for releasing the locking devices 36 or 175 so that the closures 6 can be lifted by hand. The provision of motors (the springs 174 can be said to constitute elementary motors) is desirable and advantageous because they simplify the task of the teller, i.e., the teller knows that a selected closure will be automatically lifted by a step in delayed response to depression of the corresponding pushbutton 37.

It is further clear that the flexible closures 6 can be replaced by otherwise configurated closures, for example, by rigid panels which are reciprocable up and down in front of the open sides of the respective rows of drawers. The illustrated closures 6 are preferred at this time because they are flexible and can be fully concealed in the housing regardless of whether they expose a single drawer or the entire row of drawers in the corresponding container. This is due to the fact that the upper portions of the closures 6 can be moved along arcuate paths which are defined by the respective sprocket wheels 16 and 17.

As mentioned above, the delays which can be selected by the clocks 53 depend on a number of factors, such as the denominations of bills in the corresponding compartments. Other factors which must or can be considered for setting of the clocks 53 include the anticipated number of transactions on a given day, the frequency with which police patrols inspect the institution, the distance between the institution and the nearest police station and others. It is preferred to utilize clocks 53 each of which transmits signals with a predetermined minimum delay, i.e., a certain interval of time must elapse before a closure is lifted by a step, even if the teller fails to adjust the clocks 53 prior to attachment of the housing to a support or the like. Proper selection of intervals which must elapse before the closures 6 can be lifted is desirable and advantageous because this further reduces the likelihood of substantial losses in the event of a robbery. All that a robber is likely to amass is the number of bills which are accessible at the time of robbery. In fact, even if a robber accepts the risk of awaiting the exposure of one or more additional currency-containing drawers, such criminal is highly unlikely to await the lifting of closures which can be moved upwardly after elapse of relatively long intervals of time, e.g., ten, twenty or more minutes. Moreover, insitutions in areas which are frequently visited by robbers are not likely to store paper money of large denominations, e.g., hundred dollar or five hundred dollar bills. This further reduces the likelihood of large hauls by unauthorized persons. Institutions which are located in areas likely to be visited by robbers can utilize safes wherein at least one closure cannot be lifted at all except by detaching the safe from its support. Such closure protects drawers which are used for storage of bills of large denominations, i.e., of bills which are deposited by customers and are not intended to be handed over to a customer or to anyone else. The teller then simply observes the accumulation of large bills in the single accessible drawer of the corresponding container and lowers the respective closure from time to time in order to insure that the contents of such container cannot be handed over to unauthorized persons.

The provision of switch 54 does not reduce the safety of stored valuables because this switch is accessible only after the housing of the safe is detached from its support. On the other hand, the switch 54 enables authorized persons to gain access to the entire contents of the safe without any delay when the bank is closed to the public. The teller who wishes to count the contents of the safe after business hours simply detaches the housing from the support and actuates the pushbutton of the switch 54 to effect immediate movement of all closures 6 to their fully open positions. When the safe is in actual use, the switch 54 is concealed and is accessible only after the elapse of a relatively long interval of time which is selected by appropriate setting of the finger 67A so that a robber is highly unlikely to await the elapse of such interval, the detachment of safe from its support and actuation of pushbutton of the switch 54 in order to compel a teller to hand over the entire contents of the safe. For example, the mounting of the safe on a support may be such that detachment of the housing from the support during business hours automatically triggers a silent alarm which informs the authorities that a robbery is in progress. As mentioned above, the teller will or can actuate the switch 52 prior to closing to insure that the housing can be detached from the support immediately or soon after closing. Consequently, the fact that a certain interval of time must elapse after actuation of the switch 54 does not result in longer working hours because the actuation can take place at a time when the bank is still open to the public but the timing of actuation is such that detachment of the housing is possible only after closing.

It is further within the purview of the invention to resort to a modular construction of the safe. Thus, each container and its controls may constitute a discrete unit which is transferrable into and from a vault independently of other containers. Two or more containers can be assembled in a teller's cage to form a group of containers similar to that shown in FIG. 1. In such instances, each container is preferably provided with means for securing it to a support independently of the other containers.

Still further, the safe of the present invention can be assembled of one or more containers for currency of lower denomination wherein the closures are movable up or down without any delay, and of one or more containers which are constructed in a manner as shown in FIG. 2 or 5, i.e., with closures which can be readily lowered but can be lifted only after elapse of a preselected interval. For example, bills of large denominations can be stored in containers which have closures controlled by time delays and bills of smaller denominations can be stored in containers wherein the closure can be moved up or down whenever the teller so desires. It is preferred to assemble the just described safe of containers whose outward appearance is identical or similar so that a would-be robber cannot ascertain whether or not all of the containers are protected by time-delay devices.

The switch 54 can be replaced with a switch which is accessible at the outer side of the housing 1, e.g., at the rear side adjacent to the switch 52. In such safes, the switch which replaces the switch 54 is actuatable by a key which is not accessible to the teller, e.g., by a key which is stored at a location remote from the housing. The key is picked up from such remote location after business hours and is used to effect simultaneous movement of all closures 6 to fully open positions.

The preceding description deals mainly with use of the improved safe in a bank or a similar institution which handles paper money, travellers' checks or like negotiable instruments adapted to be stacked on top of each other. However, and as already explained hereinbefore, the improved safe can be used with equal advantage for storage of precious stones, watches, pieces of jewelry, gold coins, gold bars, rare stamps and other valuables.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the claims.

What is claimed is:

1. A safe for storage of paper money or other valuables, comprising a container having a plurality of compartments for storage or valuables therein, each of said compartments having an open side affording access to its interior; closing means for said open sides of said compartments, said closing means being movable between a plurality of positions in each of which a different number of said open sides is accessible; releasable means for locking said closing means in each of said positions thereof; means for generating signals at desired intervals; and means for releasing said locking means with a predetermined delay following the generation of a signal to permit movement of said closing means to a different position.

2. The safe of claim 1, wherein said compartments are adjacent to each other and said closing means comprises a single closure.

3. The safe of claim 2, wherein the open sides of said compartments form a row and said closure is movable lengthwise of said row.

4. The safe of claim 2, wherein said closure is movable in a first direction to reduce the number of accessible open sides and in a second direction to increase the number of open sides, and further comprising means for limiting the extent of movement of said closure in said second direction so that each movement in said second direction results in accessibility of a single additional open side.

5. The safe of claim 4, wherein said closure is freely movable in said first direction.

6. The safe of claim 5, wherein said locking means comprises means for preventing the movement of said closure in said second direction from each and every position of said closure except with said predetermined delay following the generation of a signal.

7. The safe of claim 1, further comprising means for moving said closing means in a direction to increase the number of accessible open sides upon elapse of said predetermined delay.

8. The safe of claim 1, wherein said closing means comprises a plurality of articulately connected slats.

9. The safe of claim 1, wherein said releasing means comprises a timer which is adjustable to vary the duration of said delay.

10. The safe of claim 9, further comprising a second container, second closing means for said second container, second locking means for said second closing means, second signal generating means, and second releasing means for said second locking means, said second releasing means being responsive to signals from said second signal generating means and comprising a timer which is adjustable independently of said first mentioned timer so that the delay which is selected by said first mentioned releasing means need not match the delay which is selected by said second releasing means.

11. The safe of claim 1, further comprising normally concealed means for releasing said locking means independently of said first mentioned releasing means.

12. The safe of claim 1, further comprising a support for said container and means for releasably securing said container to said support.

13. The safe of claim 12, further comprising means for generating second signals at the will of an operator, and means for releasing said securing means with a predetermined delay following the generation of a second signal.

14. The safe of claim 1, wherein said closing means is freely movable in a first direction to reduce the number of accessible open sides and said locking means normally prevents the movement of said closing means in a second direction to increase the number of accessible open sides, and further comprising means for moving said closing means in said second direction on elapse of said delay, said moving means including resilient means and means for stressing said resilient means in response to movement of said closing means in said first direction so that said resilient means dissipates energy and moves said closing means in said second direction on generation of a signal and subsequent to elapse of a predetermined delay.

15. The safe of claim 14, wherein said locking means comprises a rotary ratchet wheel, means for coupling said ratchet wheel with said closure to cause said ratchet wheel to rotate in first and second directions in response to movements of said closing means in the respective directions, pawl means adjacent to said ratchet wheel and means for biasing said pawl means against said ratchet wheel to prevent rotation of said ratchet wheel in said second direction.

16. The safe of claim 15, wherein said releasing means comprises means for disengaging said pawl means from said ratchet wheel after elapse of said delay.

17. The safe of claim 16, wherein said disengaging means comprises second pawl means and means for moving said first mentioned pawl means away from said ratchet wheel against the opposition of said biasing means and through the medium of said second pawl means.

18. The safe of claim 17, wherein said moving means comprises a crank drive.

19. The safe of claim 1, wherein said compartments are disposed one above the other and further comprising means for moving said closing means in a direction to increase the number of accessible open sides by one after elapse of said delay.

20. The safe of claim 19, wherein said closure comprises an endless flexible element and said moving means comprises motor means for said flexible element.

* * * * *